US005497541A

United States Patent [19]

Nogueira

[11] Patent Number: 5,497,541

[45] Date of Patent: Mar. 12, 1996

[54] STAPLING MACHINE FOR SPRING CARCASS FRAMES

[75] Inventor: Jose L. A. Nogueira, Madrid, Spain

[73] Assignee: Fabricas Lucia Antonio Betere, S.A. (Flabesa), Madrid, Spain

[21] Appl. No.: 988,223

[22] Filed: Dec. 9, 1992

[30] Foreign Application Priority Data

| | | | |
|---|---|---|---|
| Dec. 12, 1991 | [ES] | Spain | 9102769 |
| Dec. 12, 1991 | [ES] | Spain | 9102770 |
| May 29, 1992 | [ES] | Spain | 9201111 |

[51] Int. Cl.[6] ..... B23P 19/00

[52] U.S. Cl. ..... 29/33 K; 29/91; 227/103

[58] Field of Search ..... 29/33 K, 243.56, 29/235, 33.52, 91, 91.1, 564.1, 566.1, 712, 753; 227/85, 86, 88, 103, 107, 152

[56] References Cited

U.S. PATENT DOCUMENTS

| | | | |
|---|---|---|---|
| 2,382,226 | 8/1945 | Hodges, Jr. | 29/564.8 |
| 3,084,345 | 4/1963 | Hodges, Jr. | 227/103 X |
| 3,503,115 | 3/1970 | Kirchner | 29/225 X |
| 4,724,590 | 2/1988 | Langas et al. | 29/91 |
| 4,764,179 | 8/1988 | Yajima | 29/33 K |
| 4,815,182 | 3/1989 | Langas et al. | 29/91 |
| 4,829,643 | 5/1989 | Ayres et al. | 29/91 |
| 4,907,327 | 3/1990 | Ayres et al. | 29/91 |
| 5,042,124 | 8/1991 | Knöpfel | 29/33 K |

*Primary Examiner*—William Briggs
*Attorney, Agent, or Firm*—Helfgott & Karas

[57] ABSTRACT

It is provided with a longitudinal bearing (2) mounted on a frame (1) and framed by two side, vertical and parallel guides (9) and (10), the position of the latter being adjustable in order for the spacing thereof to match the thickness of the spring carcass, which is hauled by a thruster (4) driven by a motor reducer (5) intermittently towards the working area of two stapling heads (12–12) where a retractable ram (15) receives the spring action directly and adjusts, in accordance with the latter's diameter, the position of the balance lever acting on the proximity detector that in turn controls the movement of the motor reducer (5) in order for each spring to duly face the stapling heads (12). Beyond these stapling heads is provided a tray (21) that can swing by means of a lower pneumatic cylinder capable of overturning the spring carcass (3) once all the springs on one of its sides have been stapled, in order that the latter may continue to receive the machine action on another edge, until its whole perimeter is finished.

10 Claims, 14 Drawing Sheets

C-D

E-F

STAPLING MACHINE FOR SPRING CARCASS FRAMES

OBJECT OF THE INVENTION

The present invention relates to a machine that is specifically designed for the fully automated stapling of spring carcasses used habitually in making mattresses, cushions and other upholstery or like elements.

BACKGROUND OF THE INVENTION

Within the scope of the manufacture of mattresses, cushions and other like elements one of the commonly used solutions is to structure their core from a spring carcass, provided with a number of springs that are duly stiffened to one another in order for the axes to be parallel and at right angles to the general mattress plane, to form a block shaped as a quadratic prism fitted with two side frames that each generally comprise a strip that is at all event rectangular, the frames being duly fixed to the block of springs, in particular fixed to all the marginal springs in such block, using wires or staples. Among the various existing possibilities, staples are convenient in that their ends cannot accidentally constitute sharp elements, and in particular butterfly staples are closed through flanges that determine tongue and groove couplings that will, if the staple should open slightly by chance, prevent the spring wire or the frame rod from being released, as is the case with rectangular staples.

The best solution is therefore currently where the springs fixed to the side frames in order to make up the carcass are so fitted by staples and in particular using butterfly staples.

This stapling operation is sometimes effected manually, either using pneumatic guns with prefabricated staples, where the operator moves to find the best places for the staples or with fixed unit stapling positions above which the operator places the spring carcass, moving the same as the staples are provided, which being fixed can also become means with a self-production of staples from a reel of material.

There are machines that in addition to having stapling heads are able to produce their own staples, their disadvantages being on the one hand that they work horizontally, viz. with the spring carcass resting on one of its face-sides, thereby taking up a considerable amount of space, which is frequently not available, and are in any event very expensive, a further aggravation being that the machine is structurally very complex, expensive and uses a considerable amount of stapling heads acting only on one of the faces of the spring carcass, whence the said carcass must be overturned once the springs on one of its faces have been stapled.

There are also machines that could be termed "vertical" inasmuch as they work with the spring carcass positioned vertically, thereby taking up a considerably smaller amount of space, but machines of this kind known to date are only able to use prefabricated staples, and are also structurally complex and not fully automated.

DESCRIPTION OF THE INVENTION

The stapling machine subject of the invention belongs to this second kind, viz. the so-called "vertical" machines that hence take up very little space, and is equipped with means to produce its own staples, being structurally simple and affording a fully automated operation.

More specifically and in order to achieve the above, the said machine is constructed with a considerably elongate frame on which a lower horizontal bearing is established to place the spring carcass, where as is usually the case, the block of springs is fixed to the side frames completing the carcass only through the four springs located at the corner thereof, a thruster working with the said longitudinal bearing activated by an adequately controlled motor, the said longitudinal bearing being framed by two side guides, one at the front and one at the rear, adequately stabilising the spring carcass sideways when the same is displaced towards the working area of a pair of stapling heads, acting counterpoised to both edges of the spring carcass.

At the area where the said stapling heads are established the machine is also provided with a sort of retractable ram acting against a spring and tending at all times to take up an upper end position, being displaced to a greater or lesser extent in accordance with the diameter of the kind of spring used, which ram will be connected to a balance lever with its relevant balance weight acting on a proximity detector in charge of controlling the forward movement of the thruster in order to establish an intermittent motion for the spring carcass causing the same to stop at each new spring, to face the pair of stapling heads that shall act upon the said carcass.

The said bearing for the spring carcass to slide on extends beyond the machine's stapling area into a sort of swing tray, coplanar with the said bearing and driven by a pneumatic cylinder, which tray remains horizontal and coplanar with the said support during stapling of all the springs to either of the edges of the spring carcass, and after the said edge is stapled swings upward to cause the spring carcass to contemporaneously swing 90° whereupon the said carcass shall rest on the aforesaid bearing through a new edge, for perimetric stapling to continue.

In order to avoid uncontrolled and undue movement of the spring carcass during this swinging operation, the said swing tray is provided to work with an interlocking mechanism comprising a number of cogs driven by a pneumatic cylinder and duly guided by a disc, able to "nail" the spring carcass, holding the same still as regards the said tray, with which the said interlocking mechanism travels throughout the swinging movement.

Given that the said interlocking mechanism is located behind one of the side guides framing the area of travel of the spring carcass, the rear guide is provided with a large open arched window with a range of almost 90° allowing the said interlocking mechanism to move thus.

In accordance with another characteristic of the invention, one of the said side guides, preferably the front guide, is mounted on a mobile frame that allows the distance between side guides to be regulated in order to suit the same to the various thicknesses that the spring carcass can adopt.

The stapling head itself allows on the one hand own production of staples, and hence a lowering of the costs, and on the other a perfect guiding thereof ensuring that the latter arrive in an adequate position to the area where the said staples are provided to the spring carcass.

More specifically and in order to achieve this, the said head is constructed with a bearing plate under which the mechanism feeding the band, of any conventional kind, is established, which band crosses the deck at a right angle to reach a cutter-bender which works with two pneumatic cylinders, a first cylinder acting on the band to define the unit cut and moreover unit shape of the staples, and a second cylinder acting as a thruster to drive the ready formed staples through a guide towards a stapler which works with a third pneumatic cylinder, lying parallel to the first one, which stapling cylinder deals with the movement of the staples toward the carcass of springs that are clamped by the said staple just before the said cylinder causes the same to fall on a dolly on which the said staple closes automatically.

It is thus possible for each staple to be duly guided from the moment it is self-conformed until stapling is completed, in a wholly automatic process.

In accordance with a different embodiment of the said head, tending towards a substantial simplification thereof, the cutting cylinder and the stapling cylinder are replaced with a single cylinder fitted with a flange at the free end of its only shaft, capable of simultaneous action on two parallel rods, one to drive the cutter-bender and the other to drive the stapler. Thus and on activating the said only cylinder, while one rod shapes the staple, the other causes the staple obtained in the immediately preceding stage to be stapled.

In this different embodiment the stapling head is provided with a small auxiliary cylinder, acting just before the aforesaid main cylinder, and acting in particular on a ram that is jointed to the stapler body, closing the side of the dolly to force the terminal coil of the spring and the carcass frame rod to take up a suitable position to be optimally stapled.

DESCRIPTION OF THE DRAWINGS

In order to provide a fuller description and contribute to the complete understanding of the characteristics of this invention, a set of drawings is attached to the specification which, while purely illustrative and not fully comprehensive, shows the following.

PREFERRED EMBODIMENT OF THE INVENTION

Figure 3:
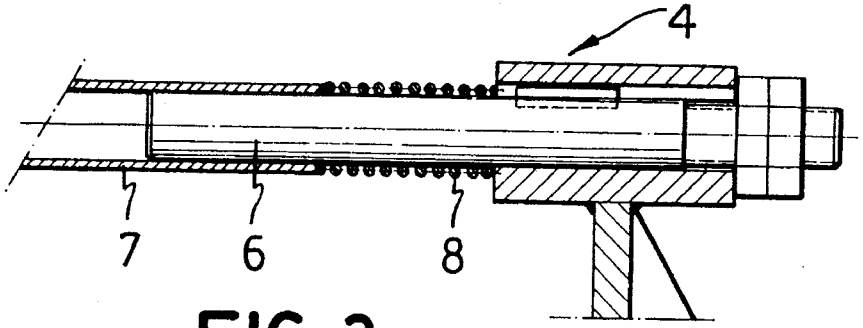
FIG. 3 is a side elevation close-up and sectional view of the thrusting abutment.
Figure 8:
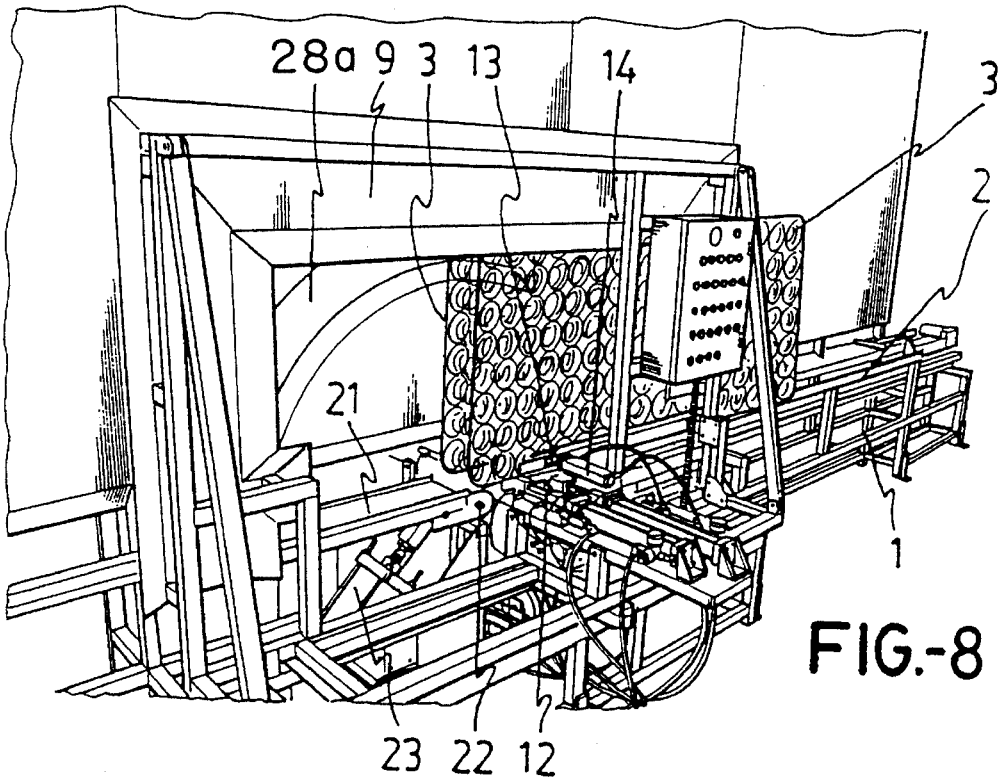
FIG. 8 is a general perspective view.
Figure 9:
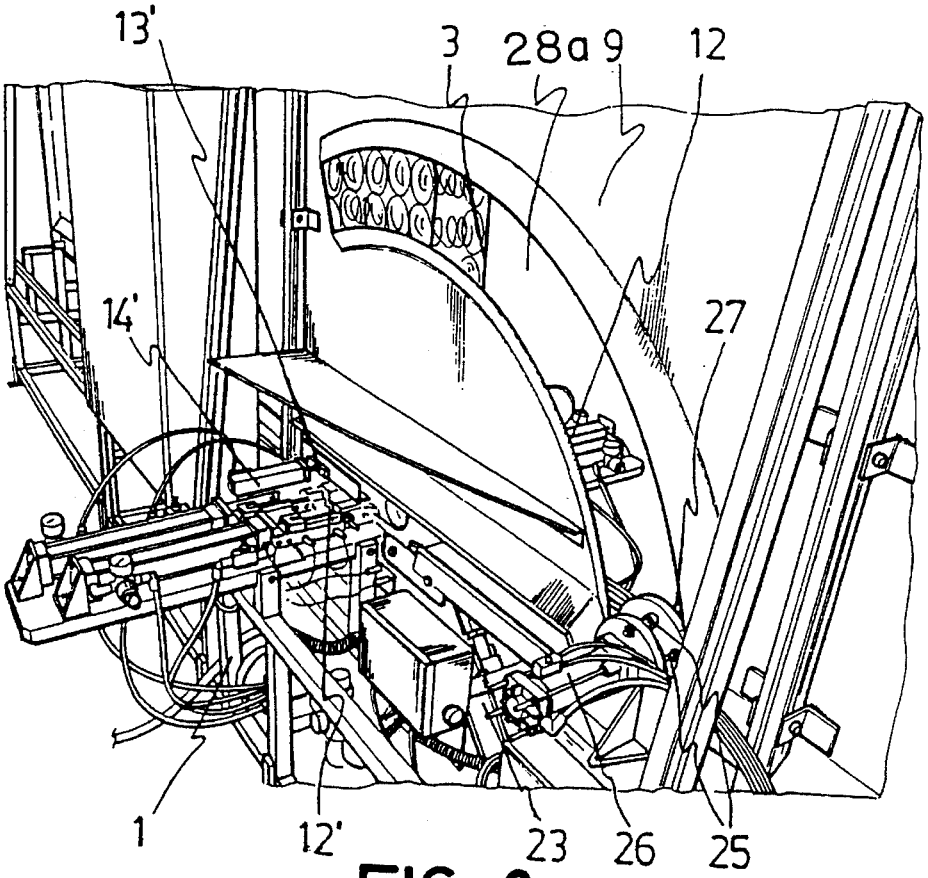
FIG. 9 is a partial perspective view counterpoised to the above.

The figures show that the stapling machine subject hereof is constructed with a considerably elongate frame (1) fitted with a longitudinal bearing (2) receiving the spring carcass (3), the latter arranged vertically, as shown in FIG. 8, the carcass (3) being hauled by a thruster (4) driven by a motor (5), which thruster (4) is constructed, as shown especially in the close-up view of FIG. 3, with a fixed core (6) and a tubular body (7) acting as the abutment or thruster as such, working with a damping spring (8) and moreover fitted with means to limit the thrust, of any conventional kind, causing the motor (5) to stop in the event of the spring carcass (3) being accidentally interlocked to prevent the spring carcass (3) from being deformed and/or irreparably damaged.

Figure 6:
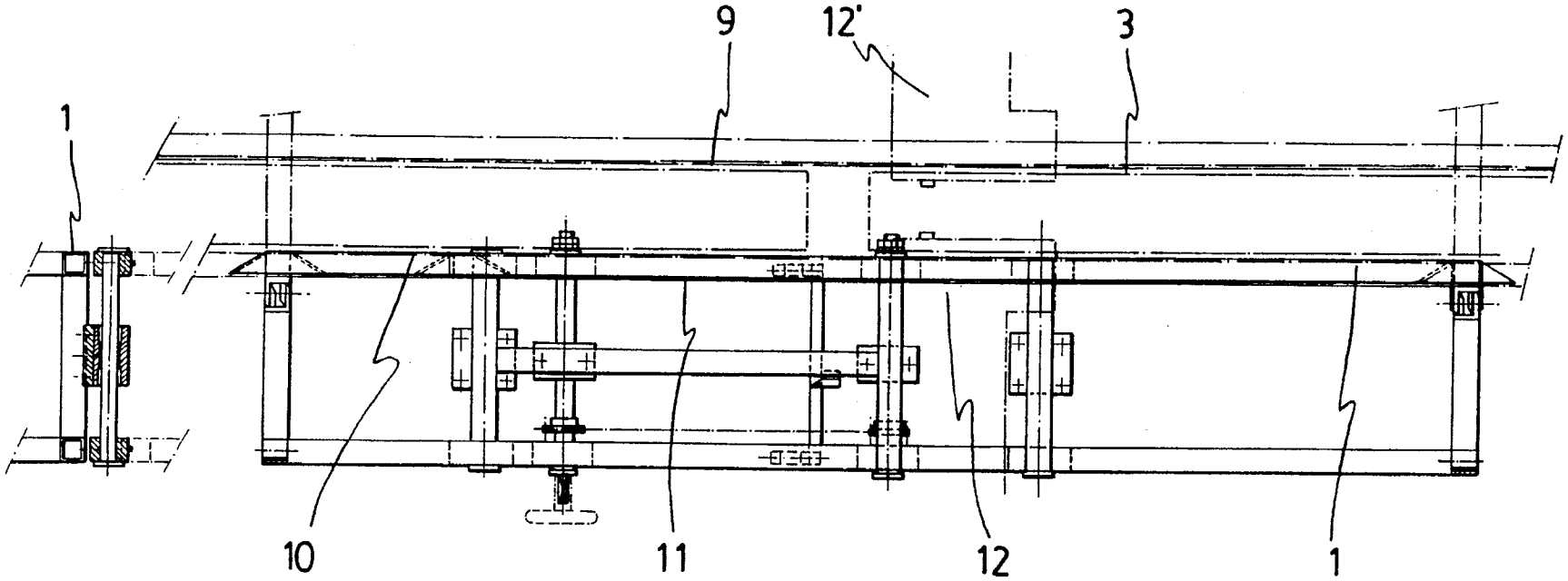
FIG. 6 is a partial plan close-up view, similar to that of FIG. 2, but to a larger scale, showing the structure of the mobile frame.
Figure 7:
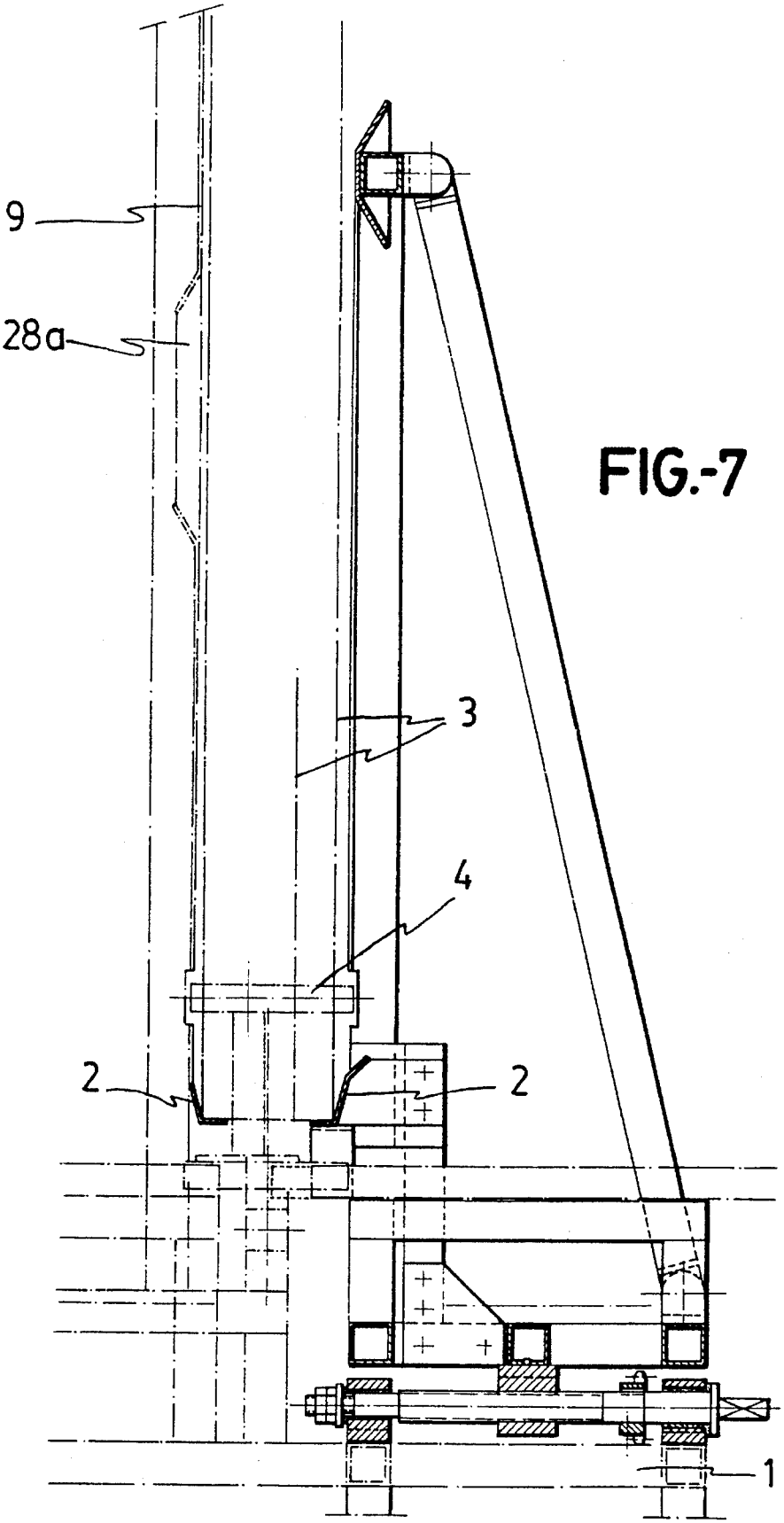
FIG. 7 is a profile view of the machine.

The bearing (2) is framed by two large guides, one at the rear (9) and comprising an oversize plate, and one at the front (10) and being slightly smaller in size, the latter being associated to and positionally adjustable on the general machine frame (1), in particular working with a mobile frame (11) and as shown in particular in FIG. 6, to adjust the spacing between the guides (9) and (10) to the various thicknesses of the spring carcasses.

Figure 10:
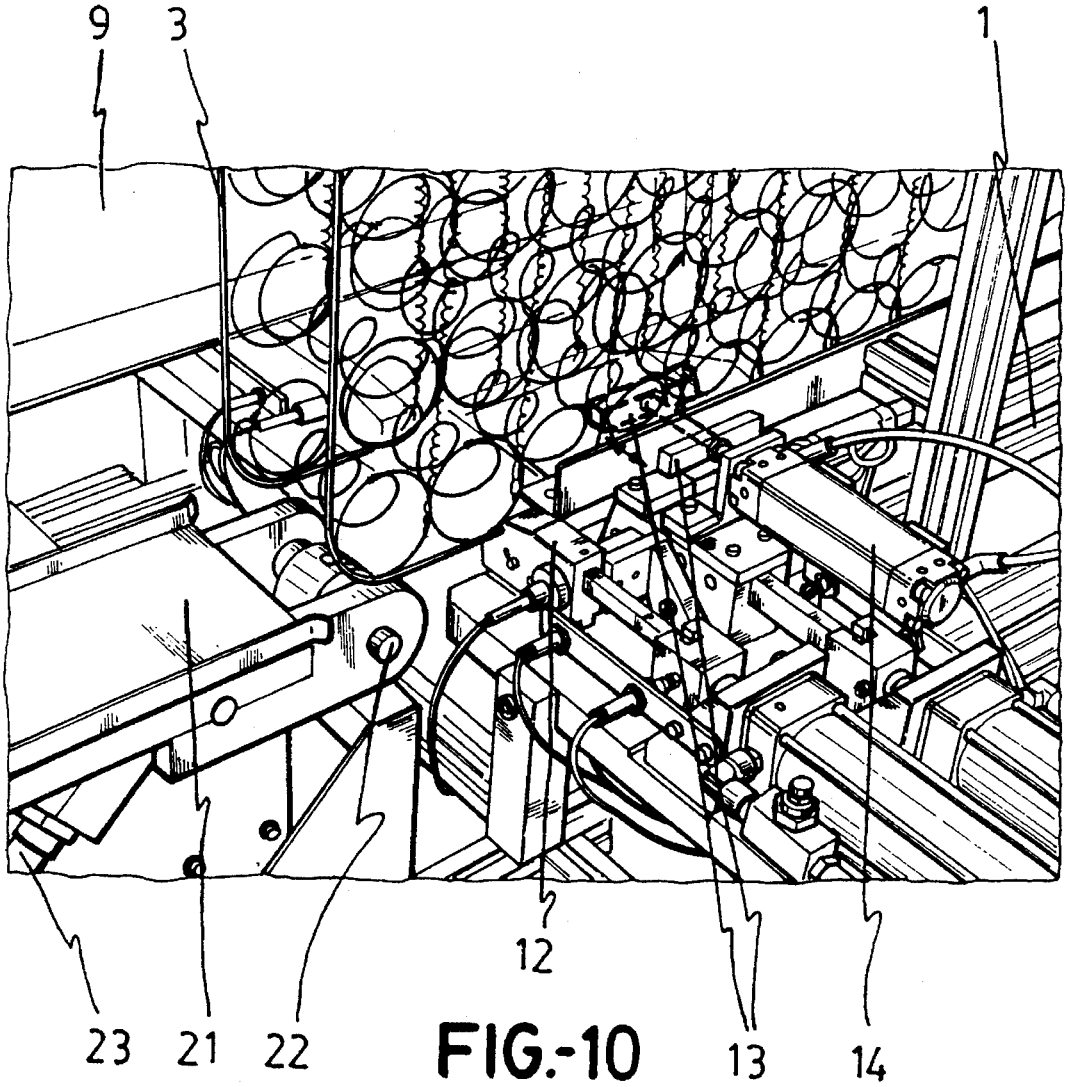
FIG. 10 is a perspective view similar to FIG. 8 but to a larger scale and focussing almost exclusively on the stapling area.
Figure 11:
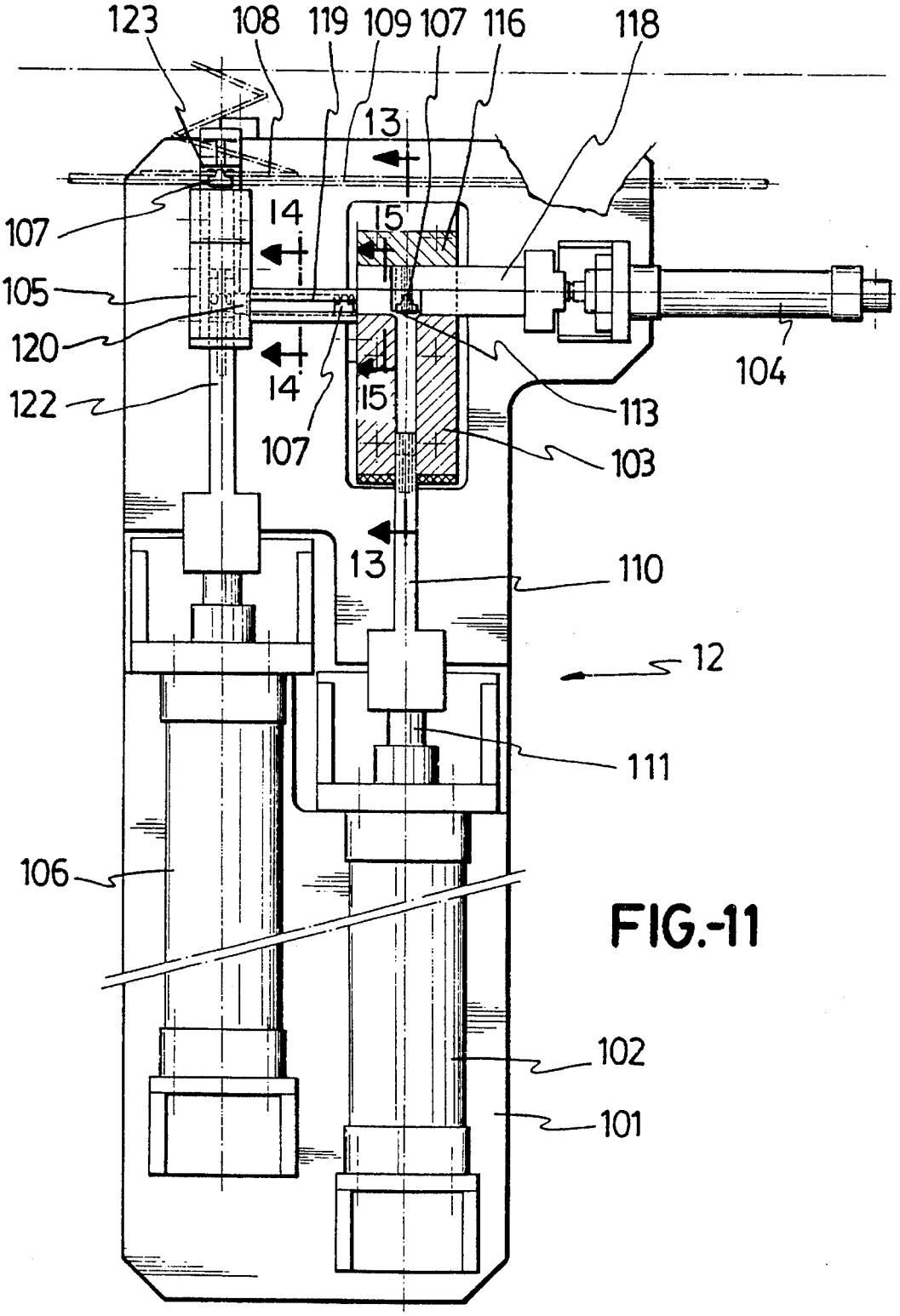
FIG. 11 is a diagrammatic plan view of the stapling head, which is shown as a cross-section at the height of the cutter-bender.
Figure 12:
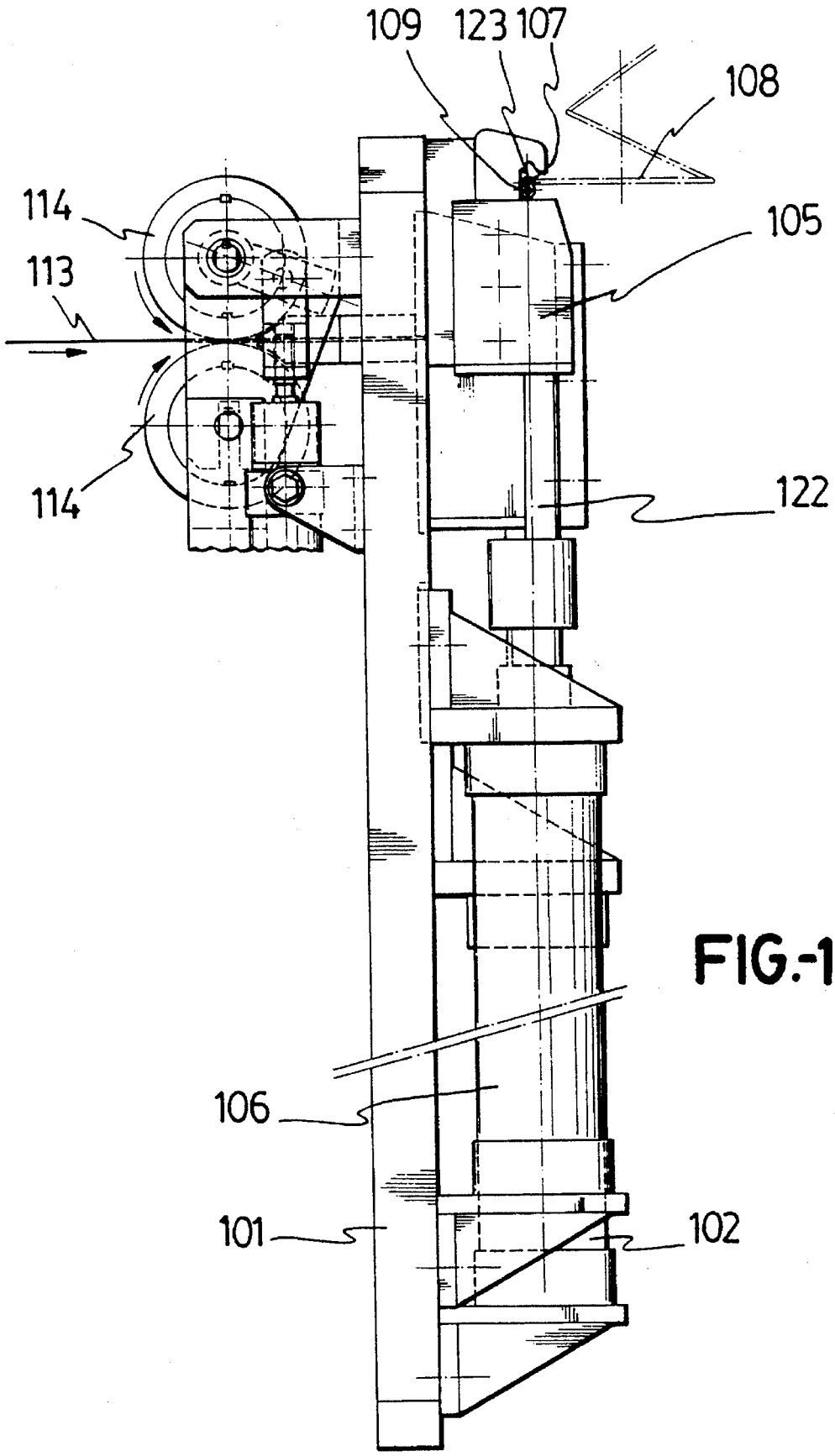
FIG. 12 is a side elevation view of the assembly shown in the above figure.

In any event, the bearing (2) and specifically its inner end is provided with a pair of counterposed stapling heads (12–12'), and right in front of them two side thrusters (13), driven by pneumatic cylinders (14), acting instantaneously on each carcass spring (3), as shown in FIG. 10, just before the stapling operation, of the carcass to force the springs to retract momentarily and hence to take up a correct position as regards the rods constituting the side thrusters.

Figure 4:
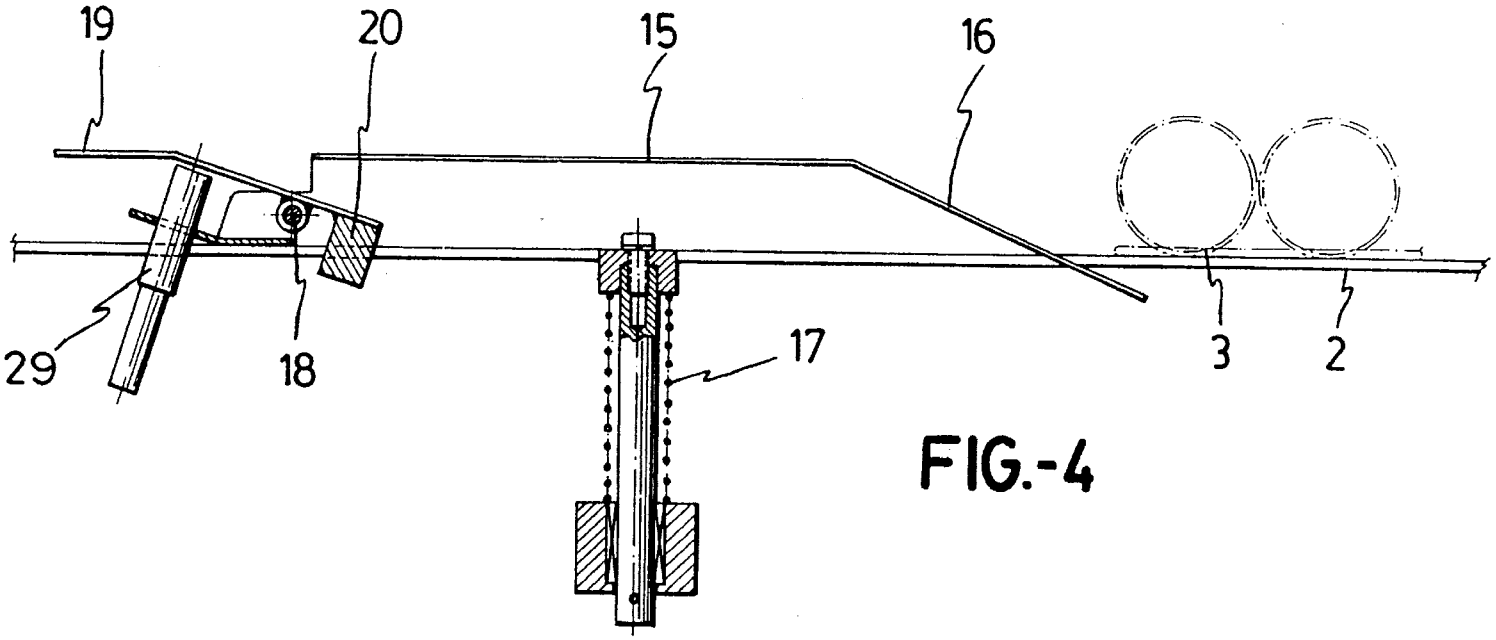
FIG. 4 is a side elevation and sectional close-up view of the mechanism controlling the stepped forward movement of the spring carcass.

This inner end area of the bearing (2) is provided, as an extension thereof, with a sort of a retractable ram (15) shown in FIG. 4 and comprising a horizontal plate having a ramp (16) for the access of the spring carcass. The springs of the carcass specifically act on the said ram (15) to cause the same to be lowered with the assistance of suitable guides and against at least a spring (17) thereby for said ram (15) to adjust its position to possible different diameters of the carcass (3) springs, the ram (15) bearing the spin axis (18) of a balance lever (19) working with a balance weight (20), which balance lever tends due to such balance weight (20) to take up a vertical position and that will in any event be driven by the repeatedly mentioned carcass (3) springs in the forward movement of the carcass, in due course, irrespective of the diameter of the springs, in order for a proximity detector (29) to cause the thruster (4) motor reducer (5) to stop at the right time for the next spring to remain facing the stapling heads (12).

Figure 1:
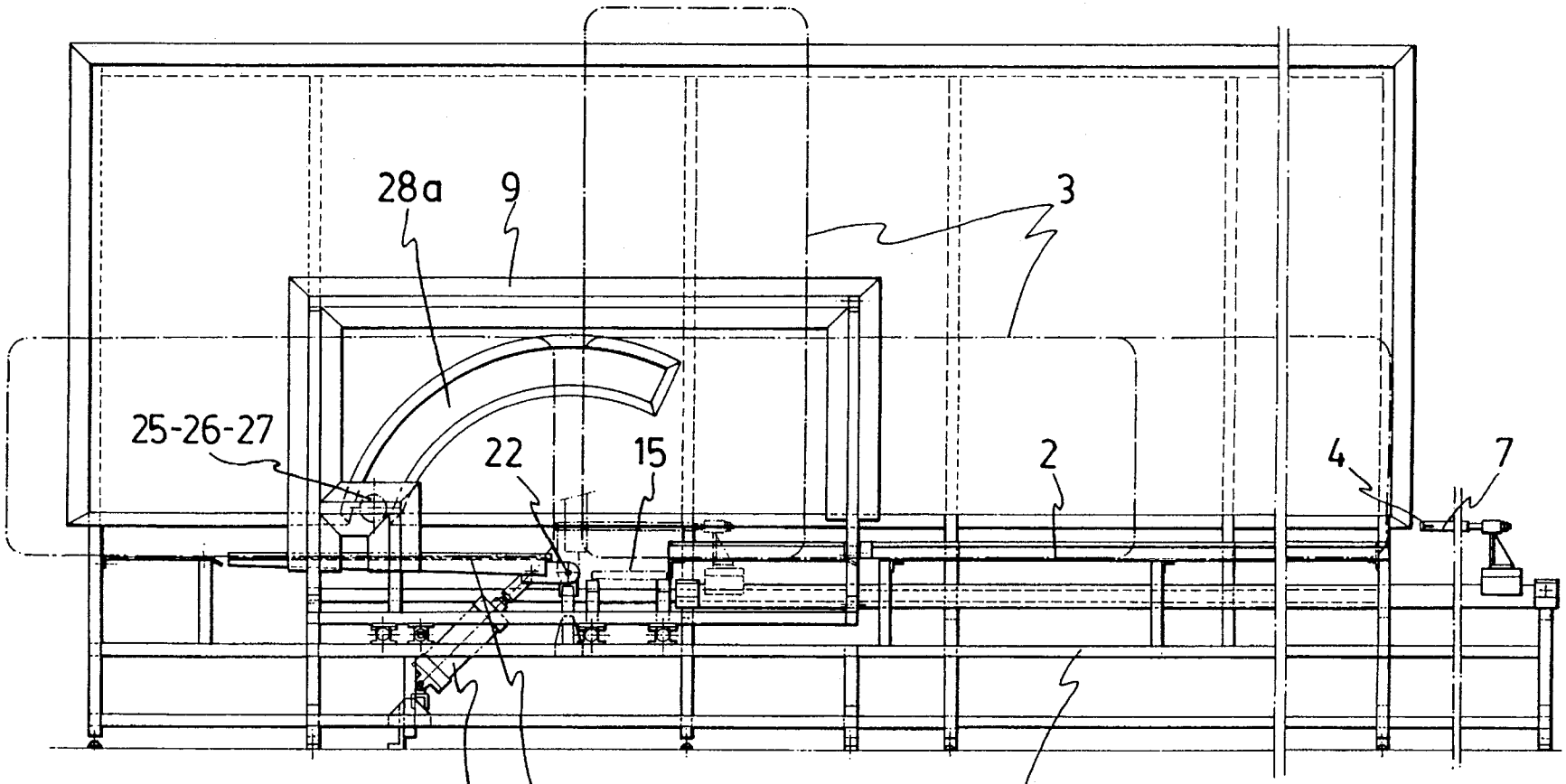
FIG. 1 is a side elevation view of a stapling machine for spring carcasses, made in accordance with the object of the present invention.
Figure 2:
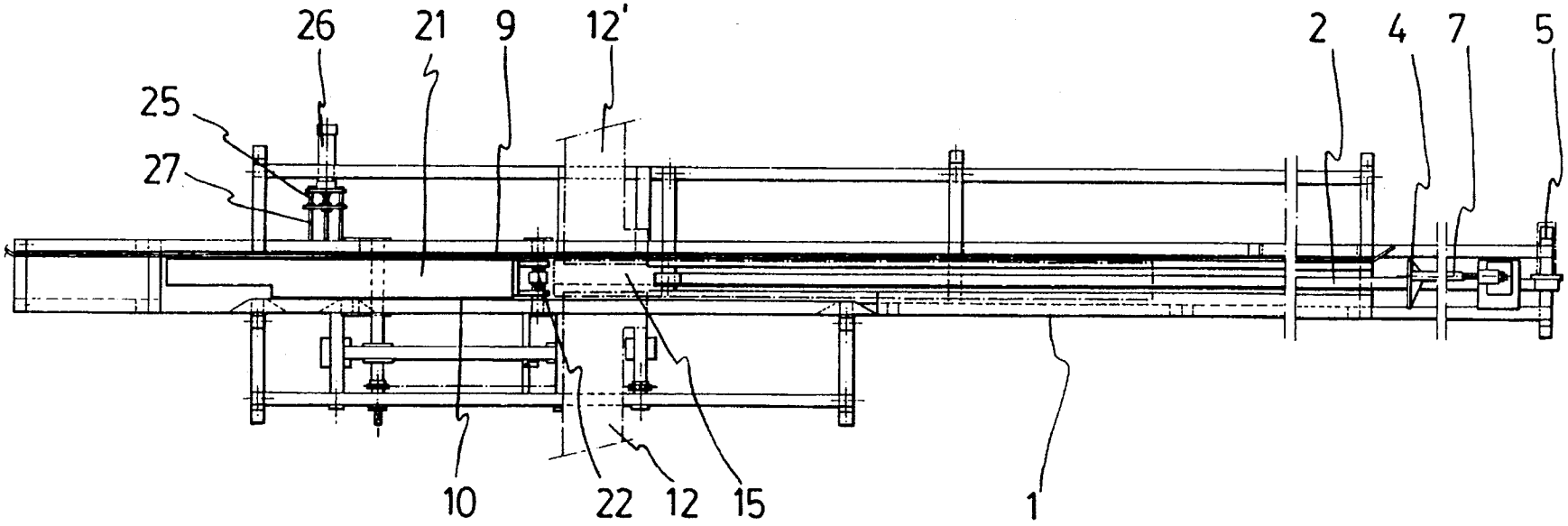
FIG. 2 is a plan view of the same machine.

Right after the ram (15), always in the forward direction along the machine frame (1) is a tray (21), as shown in FIG. 1, pivoting at its lead end about the axis (22) that can be arranged coplanarly with the bearing (2) during the normal forward movement of the carcass (3) and, on completion of the stapling of all the springs on one of the edges of the spring carcass (3), swing upwards driven by a pneumatic cylinder (23), causing the spring carcass to turn 90° thereby for a new edge thereof to take up a position on the longitudinal edge ready for the springs on that edge to be stapled.

Figure 5:
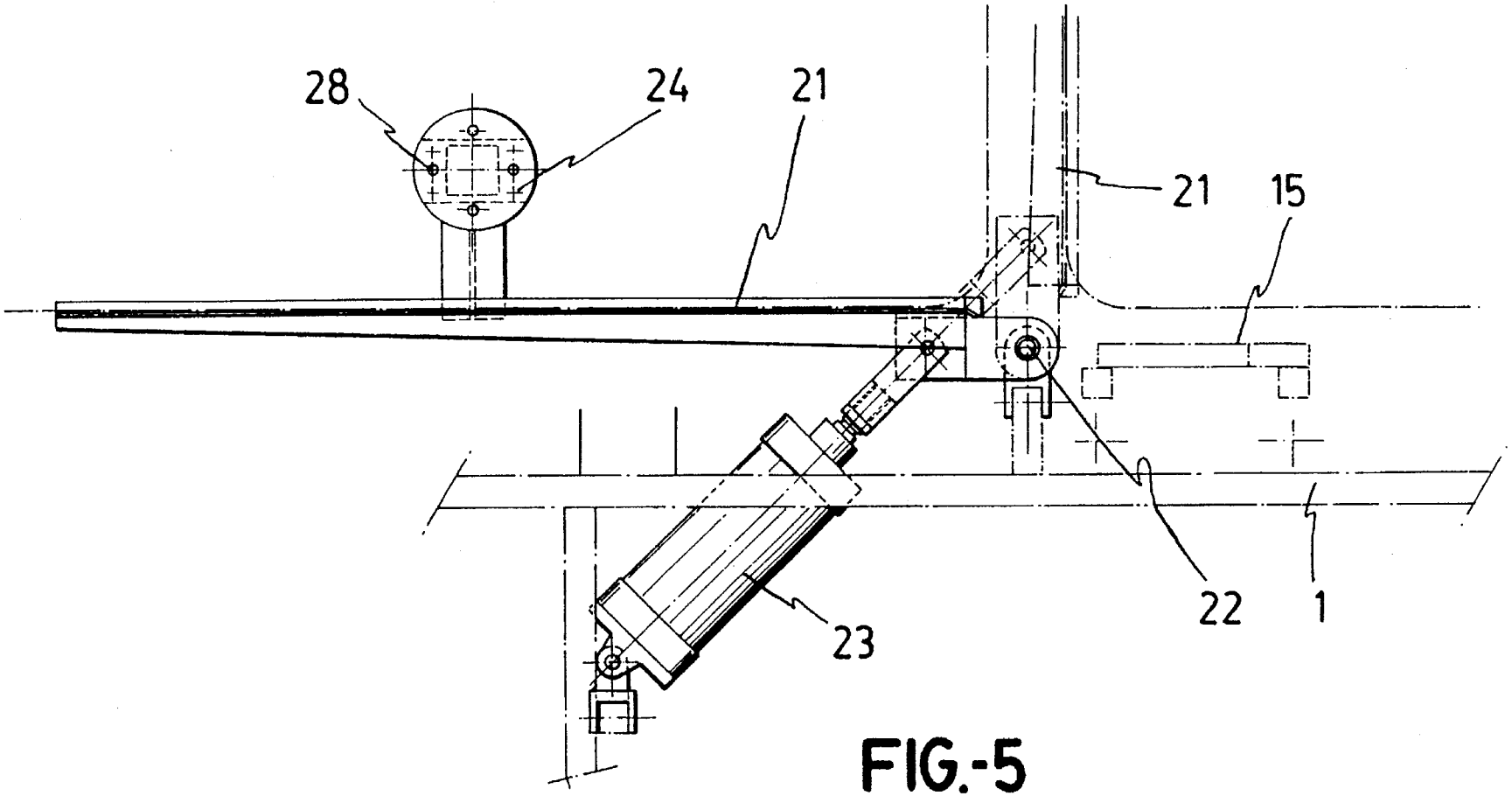
FIG. 5 is a side elevation close-up view of the swing tray and its respective drive cylinder, which assembly is shown in its two limiting positions.

It should finally be noted that in order to avoid the spring carcass (3) tendency to slide during this swinging movement, and any other accidental and unwanted movement, a guide disc (24) shown in FIG. 5 is provided on the side of the tray (21), located at quite some distance from its spin axis (22), for an interlocking mechanism (25) driven by a pneumatic cylinder (26) and having a number of cogs or needles (27) that cross holes (28) in the plate (24) and are "nailed" onto the spring carcass (3) to duly hold the same still with regard to the tray (21), the interlocking mechanism (25) travelling therewith in the swinging movement thereof, the needles (27) obviously retreating on completion of the swinging stage to release the spring carcass (3) before the tray (21) returns, dragging the interlocking mechanism (25), to its primitive horizontal position coplanar with the bearing (2), at the area leading into the machine. It should in this sense be noted that the rear guide (9) is provided with an elongate and arched window (28*a*) which allows the cogs or needles (27) to move when the tray (21) is swinging, inasmuch as the interlocking mechanism (25) is positioned behind the guide (9), as shown in particular in FIG. 1.

In accordance with the structure described and as aforesaid, it is possible on the one hand for the machine to work vertically, taking up very little space, and on the other that only two stapling heads (12) fully automatically staple all the carcass (3) springs that take up the marginal areas thereof, along its whole contour, automatically overturning the said carcass after stapling each of the said edges.

Going back to the stapling head (12), and as shown in 15 FIGS. 11 to 16, the same comprises a plate (101) on which three pneumatic cylinders are mounted, a first cylinder (102) to act on a cutter-bender (103), a second cylinder (104) to act as element thrusting the staples from the cutter-bender (103) towards a stapler (105), and a third pneumatic cylinder (106) to fix the staples (107) to the terminal coil (108) of a carcass coil and the relevant rods (109) making up the frame, as a whole.

Figure 13:
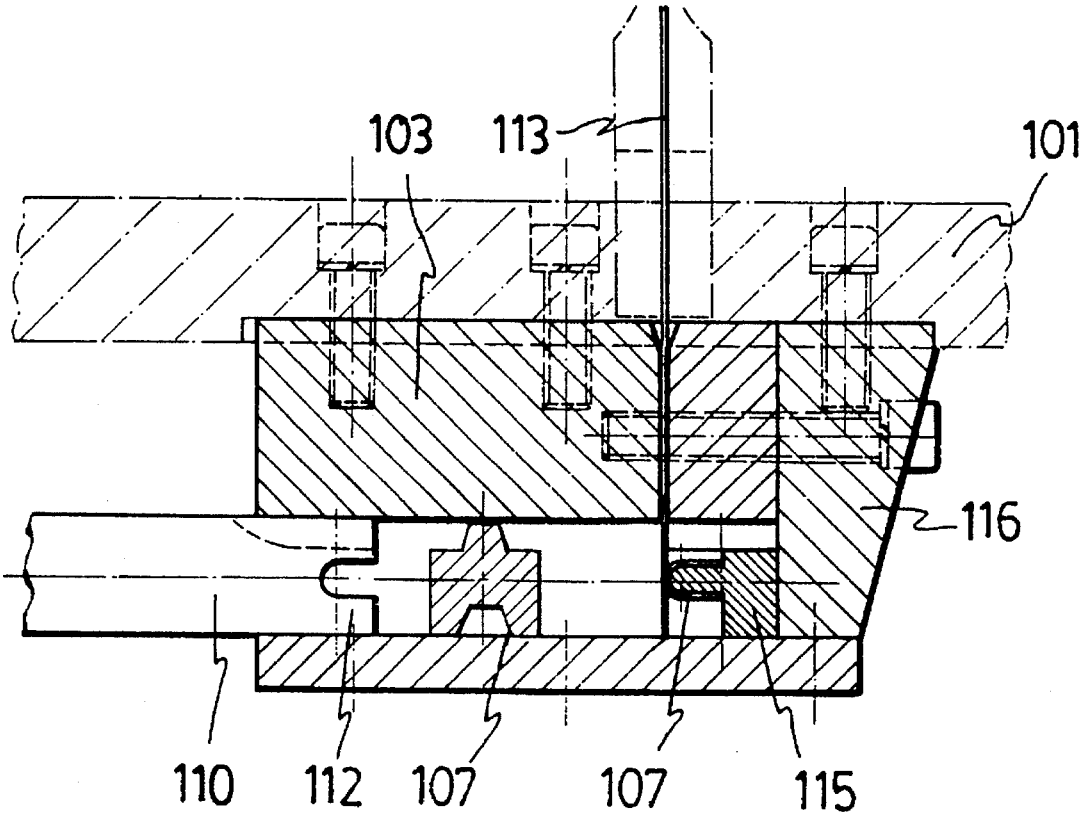
FIG. 13 is a longitudinal section close-up view of the head along line 13—13 of FIG. 11.

More specifically, the cutter-bender (103) comprises a female body, actually at (103) and clearly visible in FIG. 13, and a male element (110) integral with the rod (111) in cylinder (102), the male element (110) having its front duly notched and shaped to punch the band iron (113) fed to the head from the reel and through the relevant feed (114) in order for the staples to be shaped as a "butterfly" (107) as shown in full detail in figure 13, then bending the same to a grooved U shape, working with the relevant dolly (11) that rests on the bearing (116), duly fixed to the plate (101).

Figure 14:
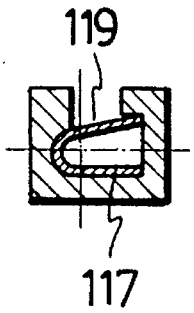
FIG. 14 is a cross-section close-up view of the guide linking the cutter-bender and the stapler, along line 14—14 of FIG. 11.
Figure 15:
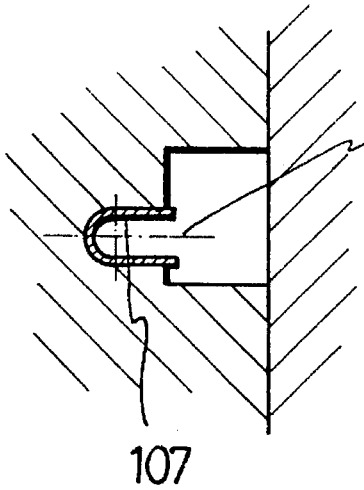
FIG. 15 is a sectional close-up view similar to FIG. 14, but at the height of the cutter-bender and along line 15—15 of FIG. 11.

The duly punched staples (107) are laterally displaced within the actual cutter-bender, in particular within the guide (117) defined thereby and clearly shown in FIG. 15, by the thruster (118) associated to the cylinder (104), arranged transversely to the former, in particular up to a guide (119) that is in turn shown in detail in FIG. 14, where the staples (107) travel longitudinally and perfectly guided, each pushing one another and with the alternating movement defined by the thrusting cylinder (104), duly synchronised with the cutter-bender cylinder (102).

Figure 16:
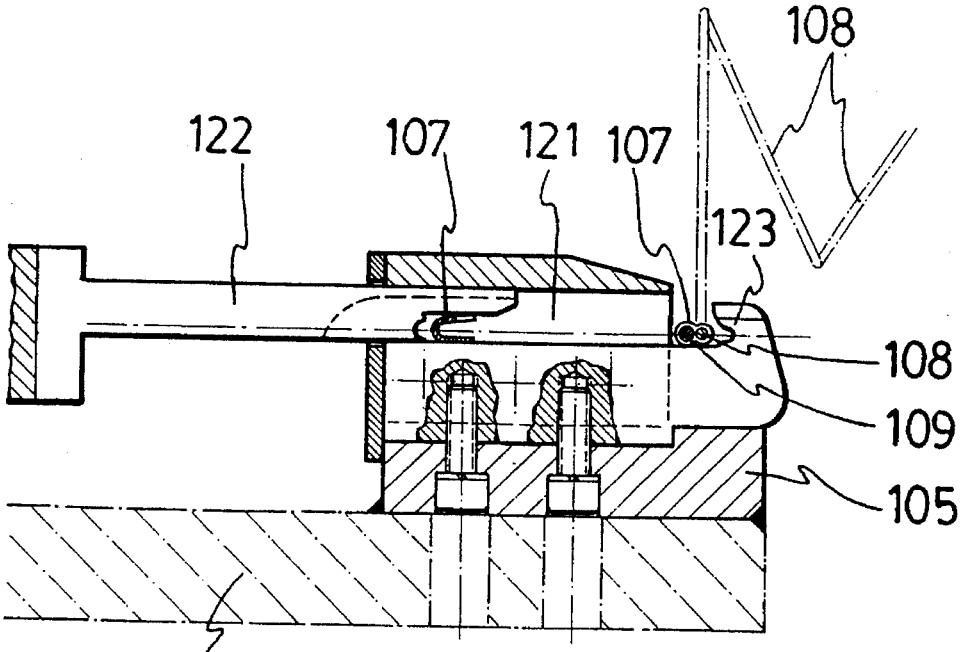
FIG. 16 is a side elevation and longitudinal section close-up view of the stapler.

The staples thus reach the stapler (105), in turn shown in detail in FIG. 16, that is also duly fixed to the plate (101) and is in addition to having a side inlet (120) for the staples provided with a longitudinal duct (121) into which the repeatedly mentioned staples (107) reach one by one and in which there is a hammer (122) driven by the third cylinder (106) which moves each staple (107) towards the stapling area in which the spring (108) and the frame (109) have been sited.

More specifically, a dolly (123) is defined in the area where the said elements are established, counterpoised to the travel of the hammer (122) and faced by the said -springs (108) and frame (109), as shown in the said figure 16, thereby for the staple (107) to close on itself and determine final stapling, on completion of the hammer (105) run and after clamping the spring and the frame.

It is therefore possible, as aforesaid, for the head to be self-sufficient as regards staple production and to be able to lead the same from where they are shaped to the stapling area under optimum stability conditions.

Figure 17:
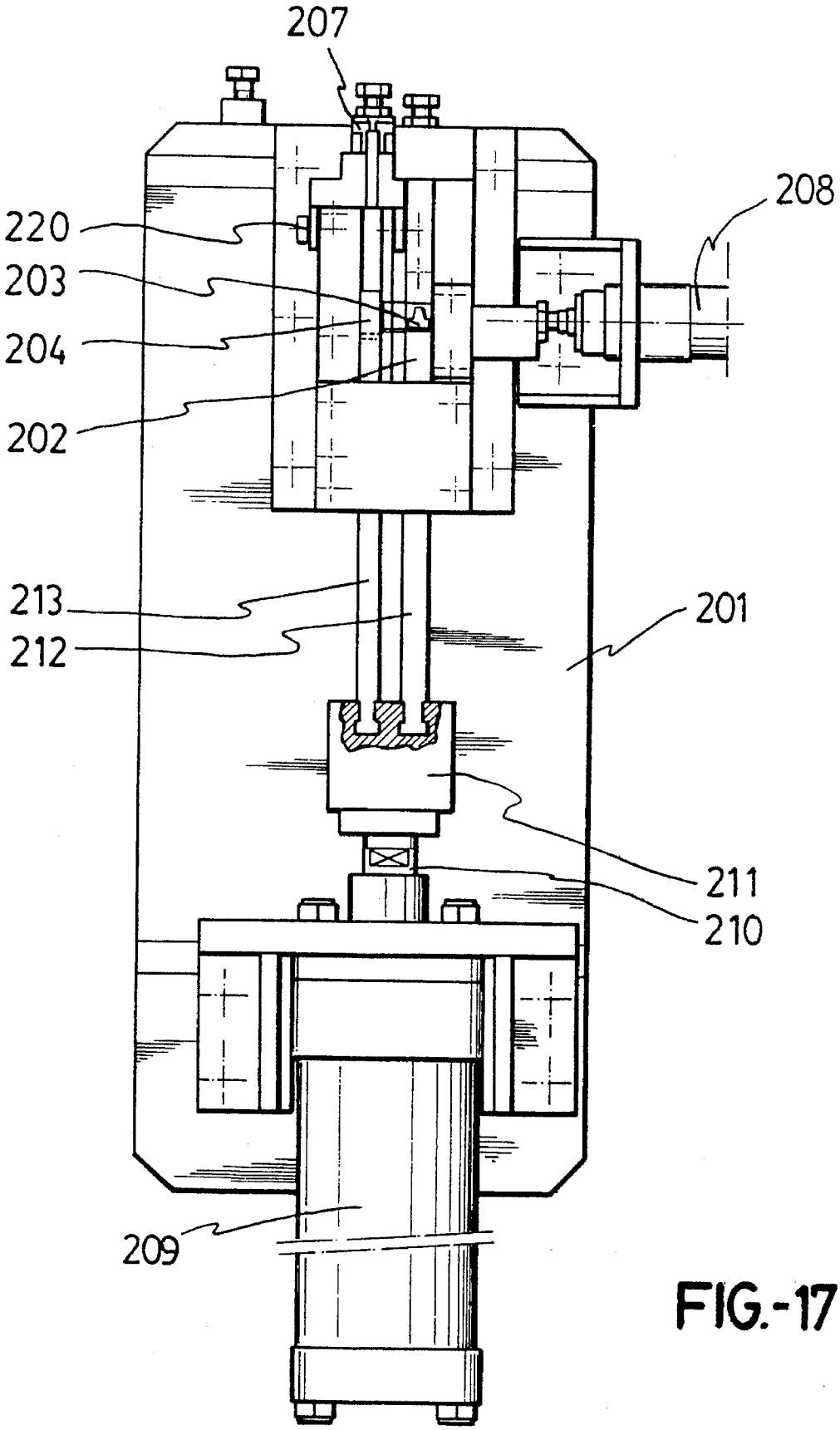
FIG. 17 is a diagrammatic plan view of a different embodiment of the stapling head.
Figure 18:
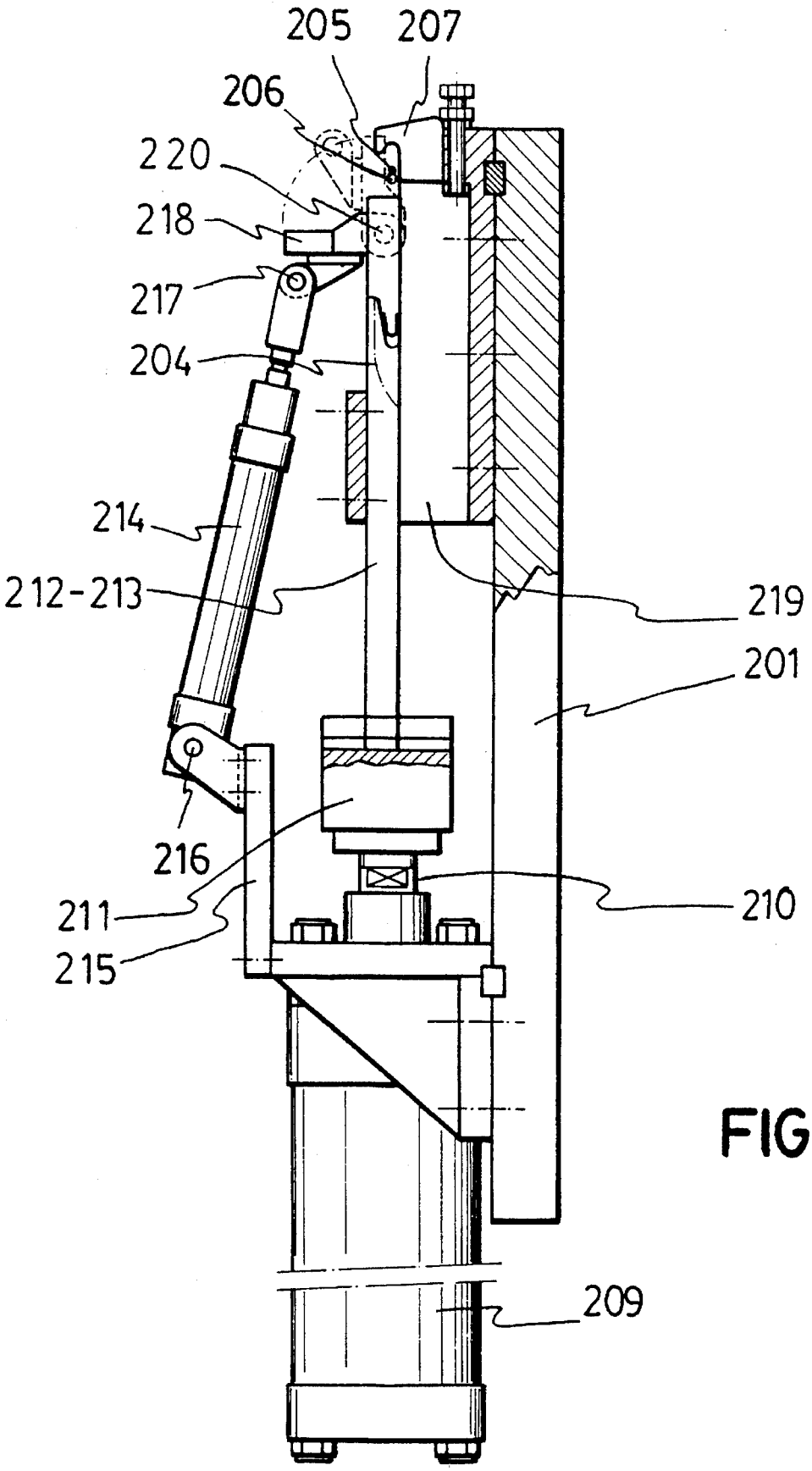
FIG. 18 is an elevation view of the assembly shown in the above figure.

In the different embodiment of FIGS. 17 and 18, the stapling head is constructed with a bearing plate (201) provided with a cutter-bender (202) to shape the staples (203) and a stapler (204) in turn to close the same on the terminal coil (205) of the spring and on the rod (206) of the frame, working with the respective dolly, each staple (203) being able to travel across from the cutter-bender (202) to the stapler (204) with the assistance of a side cylinder (208).

The cutter-bender (202) and the stapler (204), that lie rather close and parallel to each other, are driven simultaneously by a common pneumatic cylinder (209) with the free end of its rod (210) provided with a flange (211) that is suitable to simultaneously fix two parallel rods (212) and (213), the first to drive the cutter-bender (202) and the latter to drive the stapler (204), so that while the first is shaping the staple, the latter closes the staple obtained in the immediately preceding operative stage, onto the coil (205) and the rod (206).

As shown in particular in FIG. 18, the stapling head is provided with a small auxiliary cylinder (214), jointed to a bearing (2) duly stiffened to the plate (201), which cylinder (214) is joined to the bearing (2) through a joint (216) and that is also jointed through the free end (217) of its rod to the ram (218) jointed to the body (219) holding the cutter-bender (202) and the stapler (204), which ram can pivot about the axis (220) and as shown in the dash line of FIG. 18, can fall on the dolly (207) to close its side and to ensure that the terminal coil (205) of the spring and the rod (206) of the frame of the spring carcass is suitably positioned, thereby also to ensure optimum stapling conditions.

It is thus possible to achieve on the one hand a structural simplification of the stapling head and on the other a functional improvement thereof.

I claim:

1. A stapling machine for producing its own staples and for stapling spring carcass frames, said stapling machine comprising:

a pair of stapling heads;

an elongate frame;

a bearing having an inner end and being coupled on said inner end thereof to the pair of stapling heads and being fitted on the frame for receiving the spring carcass;

front and rear guides positioned vertically, in parallel relationship with each other and separated by a variably controlled distance, said front and rear guides being positioned on opposing sides of the bearing;

a motor; and a first thruster driven by the motor and engaged with the bearing for intermittently moving the spring carcass towards the stapling heads.

2. A stapling machine as claimed in claim 1, further comprising a mobile frame, wherein the front guide is mounted to the mobile frame for positional adjustment with respect to the rear guide thereby adjusting the distance between the front and rear guides in accordance with various thickness of the spring carcass.

3. A stapling machine as in claim 1, wherein the bearing further includes a ram;

a balance lever having a balance weight, and a proximity detector, wherein the ram is retractable against a force of at least one spring of the spring carcass and the ram acts to orient a spin axis of the balance lever for pivoting the balance lever about the spin axis and acting on the proximity detector acting on the first thruster to cause the first thruster to stop for a next spring of a carcass to remain facing the stapling heads.

4. A stapling machine as in claim 1, wherein the machine further includes first and second pneumatic cylinders crossing the front and rear guides; and a ram having a first side and a second side and including a ramp for expediting access of the spring carcass to the ram; and two side thrusters located on the first side of the ram and engaged with the first and second pneumatic cylinders for acting on each spring carcass to force springs of the carcass to momentarily retract causing the springs to take a correct position relative to the carcass prior to stapling.

5. A stapling machine as in claim 4, wherein the machine further includes a third pneumatic cylinder; and the ram further includes a tray on the second side of the ran, the tray having an end and being pivotable at the end thereof about an axis arranged coplanarly with the bearing during forward movement of the spring carcass, wherein the third pneumatic cylinder is engaged to swing the tray to a vertical position upon stapling of all springs on one side of the spring carcass, thereby causing the spring carcass to rest on another edge thereof in preparation for stapling the springs on the another edge.

6. The stapling machine as in claim 5, further comprising:

a guide disc coupled to the tray;

a fourth pneumatic cylinder; and an interlocking mechanism driven by the fourth pneumatic cylinder and having a number of cogs crossing the guide disc and locked between springs of the carcass, wherein the interlocking mechanism is engaged with the guide disc for preventing any unwanted movement of the spring carcass as the tray swings.

7. A stapling head for use with stapling machines to staple spring carcasses, comprising:

a cutter bender;

a stapler;

a bearing for mounting both the cutter bender and the stapler;

feeding means for feeding staples to the cutter bender;

first and second pneumatic cylinders engaged with the cutter bender;

a guide connecting the cutter bender and the stapler; and a thruster engaged with the second pneumatic cylinder and the guide wherein the first pneumatic cylinder acts on the cutter bender to shape staples continuously received from the feeding means and the second pneumatic cylinder acts on the thruster to move the staples from the cutter bender along the guide towards the stapler wherein the staple is caused to close on itself.

8. A stapling head as claimed in claim 7, wherein the stapling head further comprises a dolly and the cutter bender comprises a body having a transverse duct operatively facing the thruster and leading into the guide and the stapler comprises a hammer and a side opening through which the hammer acts, wherein the cutter bender is shaped at a free end thereof to form a "butterfly" staple and in conjunction with the dolly causes the staple to form a grooved U shape, and upon movement of the staple through both the transverse duct and guide and into the stapler, the staple is acted upon by the hammer to close on itself.

9. A stapling head for use with stapling machines to staple spring carcasses, comprising:

a bearing plate;

a bearing body;

a cutter bender;

a stapler, mounted in parallel with the cutter bender within the bearing body;

a pneumatic cylinder connected to the bearing plate, the pneumatic cylinder having a first rod and a flange at a free end thereof; and second and third rods fixed to the flange for acting simultaneously on the cutter bender and stapler causing cutting and shaping of a staple by means of the second rod and stapling a staple cut and shaped during a previous cycle by means of the third rod, and being operative during each operative cycle of the pneumatic cylinder.

10. A stapling head as claimed in claim 9, further comprising:

a dolly;

a bearing;

an additional pneumatic cylinder having a fourth rod acting on the bearing body holding the cutter bender and stapler, the additional pneumatic cylinder being coupled to the bearing plate through the bearing; and a ram coupled between the additional pneumatic cylinder and the bearing body, for acting laterally on the dolly causing the ram to close laterally to determine a correct position for a terminal spring coil and a frame of the spring carcass, thereby ensuring a correct stapling of the spring coil and the frame.

* * * * *